US007728238B2

(12) United States Patent
Shimizu et al.

(10) Patent No.: US 7,728,238 B2
(45) Date of Patent: Jun. 1, 2010

(54) DATA SETTER

(75) Inventors: Osamu Shimizu, Yokohama (JP); Hiroshi Takahira, Kawasaki (JP)

(73) Assignee: Yamaichi Electronics Co., Ltd., Tokyo (JP)

( * ) Notice: Subject to any disclaimer, the term of this patent is extended or adjusted under 35 U.S.C. 154(b) by 229 days.

(21) Appl. No.: 12/081,186

(22) Filed: Apr. 11, 2008

(65) Prior Publication Data

US 2008/0251360 A1 Oct. 16, 2008

(30) Foreign Application Priority Data

Apr. 12, 2007 (JP) ..... 2007-105175

(51) Int. Cl.
*H01H 9/28* (2006.01)

(52) U.S. Cl. ..... 200/43.01

(58) Field of Classification Search ..... 200/43.01
See application file for complete search history.

(56) References Cited

U.S. PATENT DOCUMENTS

| | | | | |
|---|---|---|---|---|
| 5,519,882 | A | 5/1996 | Asano et al. | |
| 6,039,600 | A | 3/2000 | Etters et al. | |
| 6,476,698 | B1 * | 11/2002 | Anand et al. | 335/202 |
| 6,482,027 | B2 | 11/2002 | Ishii et al. | |
| 6,495,775 | B2 * | 12/2002 | Lawson et al. | 200/50.28 |
| 6,567,866 | B1 | 5/2003 | Poisner | |
| 7,048,573 | B2 | 5/2006 | Masaki et al. | |
| 2005/0075004 | A1 | 4/2005 | Endou et al. | |
| 2006/0107290 | A1 | 5/2006 | Kado et al. | |

FOREIGN PATENT DOCUMENTS

| | | |
|---|---|---|
| EP | 0213819 A2 | 3/1987 |
| JP | 49-114844 | 11/1974 |
| JP | S58-14634 | 1/1983 |
| JP | 04-072927 | 3/1992 |
| JP | H07-1547 | 1/1995 |
| JP | 8-50976 | 2/1996 |
| JP | 9-215183 | 8/1997 |
| JP | 10-241081 | 9/1998 |
| JP | 11-195464 | 7/1999 |
| JP | 11-233275 | 8/1999 |
| JP | 2001-043462 | 2/2001 |
| JP | 2001-85874 | 3/2001 |
| JP | 2002-56935 | 2/2002 |
| JP | 3086135 | 3/2002 |
| JP | 2002-100425 | 4/2002 |
| JP | 2002-100426 | 4/2002 |
| JP | 2002-124321 | 4/2002 |
| JP | 3380539 | 12/2002 |

(Continued)

OTHER PUBLICATIONS

Office Action dated Nov. 25, 2008 in corresponding Japanese Application No. 2007-105175.
Office Action dated Feb. 17, 2009 in corresponding Japanese Patent Application No. 2007-105175.
Office Action dated Apr. 28, 2008, from the Polish Patent Office for Polish Patent Application No. P-384881.

*Primary Examiner*—Truc T Nguyen
(74) *Attorney, Agent, or Firm*—Finnegan, Henderson, Farabow, Garrett & Dunner, LLP

(57) ABSTRACT

At least one plug is selectively fit into the plug-fitting portions 12A1 to 12A8, and then a plurality of kinds of data consisting of five bits configuration are obtainable.

10 Claims, 12 Drawing Sheets

FOREIGN PATENT DOCUMENTS

| | | |
|---|---|---|
| JP | 2003-61009 | 2/2003 |
| JP | 2004-208043 | 7/2004 |
| JP | 2005-4993 | 1/2005 |
| JP | 2005-129490 | 5/2005 |
| JP | 2006-85989 | 3/2006 |
| JP | 2006-129167 | 5/2006 |
| JP | 2006-234242 | 9/2006 |
| JP | 2006-333637 | 12/2006 |

* cited by examiner

DATA SETTER

This application claims the benefit of Japanese Patent Application No. 2007-105175, filed Apr. 12, 2007, which is hereby incorporated by reference herein in its entirety.

BACKGROUND OF THE INVENTION

1. Field of the Invention

The present invention relates to a data setter capable of setting data consisting of a plurality of binary data.

2. Description of the Related Art

In a plurality of printed wiring boards to be mounted within an electronic equipment, there is a proposal, for example, in Japanese Patent Laid-Open No. 2003-061009, for the purpose of reducing the number of parts by sharing the use of substrates, wherein a second substrate on which are mounted components in the circuit such as an audio-driver or a video driver in correspondence to the use of the respective receiving equipment and a first substrate on which are mounted the components in the circuit such as CPU (central processing unit) mounted on the second substrate common to the plurality of receiving devices having different uses are electrically connected to each other so that the first substrate is commoditized.

Also, in a set data storage section provided in the first substrate in relation to the above-mentioned CPU or others, the respective control data is set in the set data storage section of a control unit by a data setter having a data storage section as disclosed, for example, in Japanese Patent Laid-Open No. 11-233275 (1999).

SUMMARY OF THE INVENTION

If the controlled mode of the components in the circuit controlled by CPU mounted on the above-mentioned first substrate are different from each other in accordance with whether the electronic equipment on which is mounted this substrate is used domestically or in the destinations abroad, it is necessary to prepare the first substrate suitable for the respective destination. Namely, in the respective first substrate, it is necessary to set control data in the set data storage section of the control unit in correspondence with the respective destination by the data setter. Accordingly, since the above-mentioned first substrates must be different from each other in the respective destination, the import for commoditizing the substrate is not achievable as well as the stock control of the substrates becomes complicated.

In such a case, it is thought that the data set in the set data storage section of the control unit is changed if necessary in correspondence to the used destination.

There is a problem, however, accompanied with changing the data of the first substrate set in the set data storage section, in that the first substrate must be in an operative condition by the supply of electric power to the control unit and the data setter to confirm the set data again, whereby the set data is not variable by a simple operation.

In consideration of the above-mentioned problem, an object of a data setter according to the present invention is to provide a data setter capable of changing data by a simple operation without bringing the substrate on which is mounted the data setter into operation.

To achieve the above-mentioned object, the data setter according to the present invention comprises at least one plug formed of electric-insulation material, having a leg portion defining a circumference forming a pressing surface and an operative portion; a main body of the data setter having a plurality of plug-fitting portions to which are detachably fit the leg portions of the plug; and a plurality of contact units arranged in the respective plug-fitting portions of the main body of the data setter and connected to a reference supply portion, wherein when the leg portion of the plug is fit into at least one of the selected plug-fitting portions among the plurality of plug-fitting portions, a plurality of kinds of data formed of a plurality of binary data are set by pressing at least one of the contact units with the pressing surface of the plug to be in a conductive state.

As apparent from the above description, according to the data setter of the present invention, when the leg portion of the plug is fit into at least one of the selected plug-fitting portions among the plurality of plug-fitting portions, at least one of the contact units is pressed with the pressing surface of the plug to be in a conductive state, and thereby a plurality of kinds of data formed of a plurality of binary data are set, it is possible to change the data in a simple operation by changing the arrangement of the plugs without bringing the substrate on which is mounted the data setter into operation.

Further features of the present invention will become apparent from the following description of exemplary embodiments (with reference to the attached drawings).

BRIEF DESCRIPTION OF THE DRAWINGS (A) to (P) in FIG. 1 are plan views, each schematically illustrating the arrangement of plugs in correspondence with set data;

DESCRIPTION OF THE EMBODIMENTS

Figure 2:
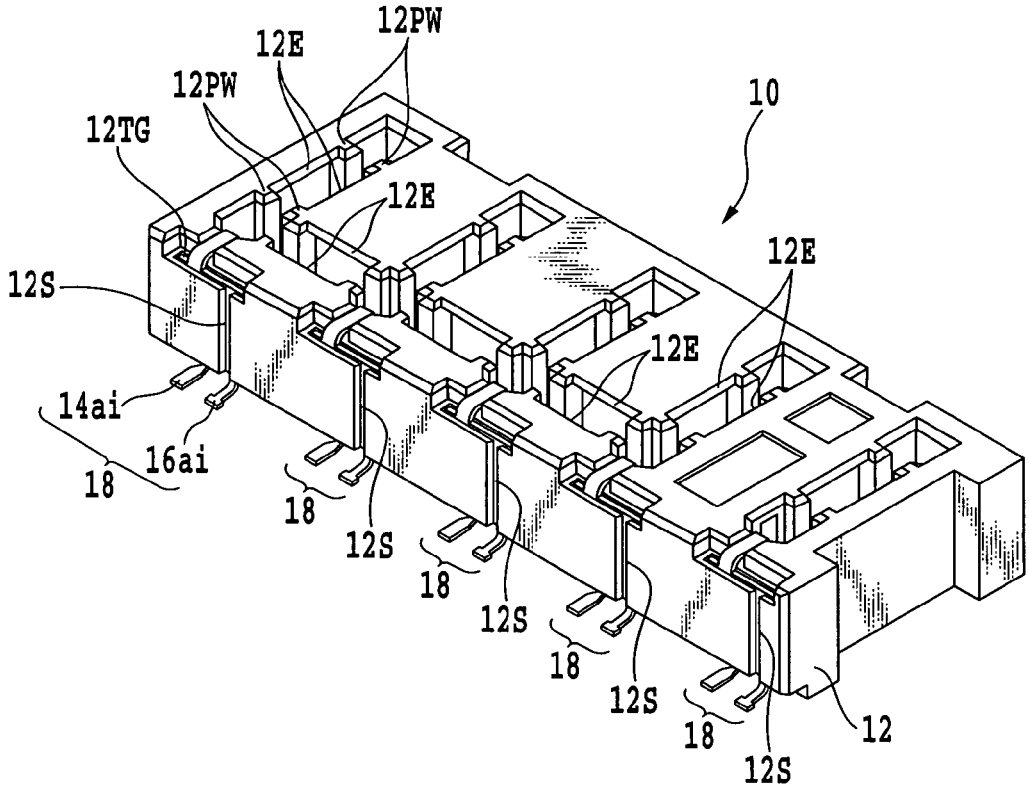
FIG. 2 is a perspective view of an appearance of a main body of a data setter of one embodiment according to the present invention.

FIG. 2 shows an appearance of a main body of a data setter according to one embodiment of the present invention.

Figure 3:
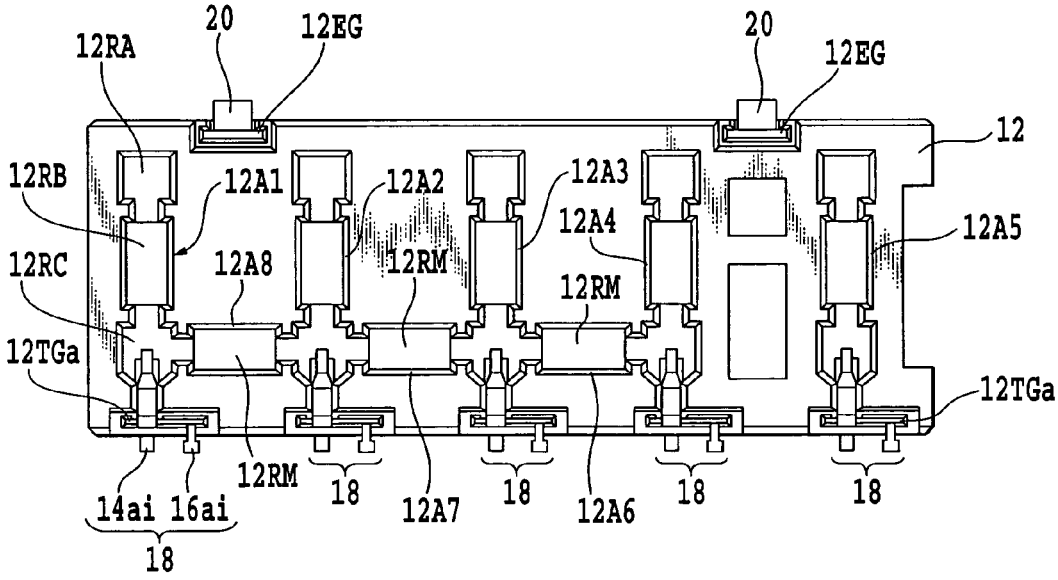
FIG. 3 is a plan view of the embodiment shown in FIG. 2.
Figure 4:
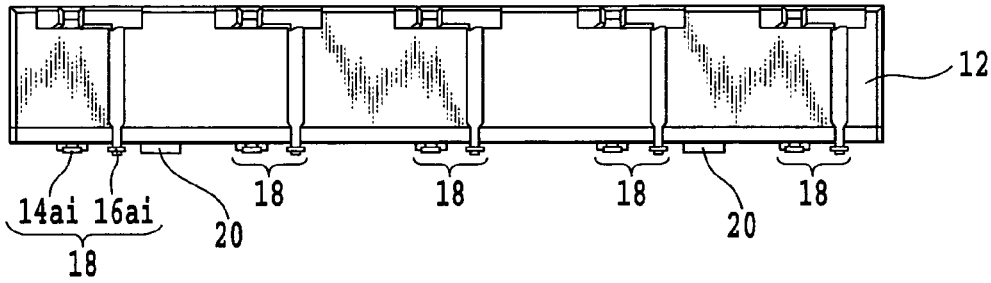
FIG. 4 is a front view of the embodiment shown in FIG. 2.
Figure 9:
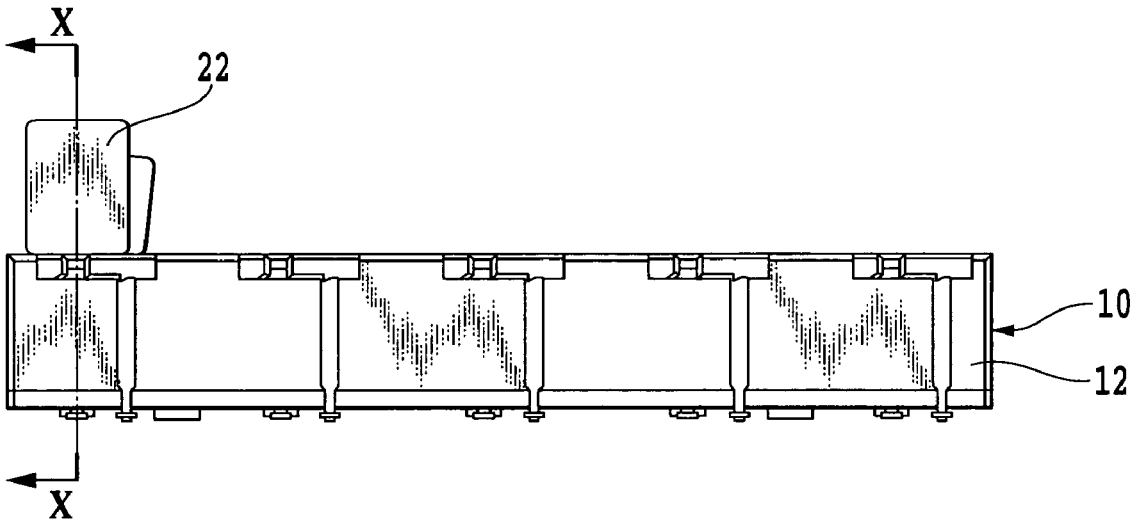
FIG. 9 is a front view illustrating an appearance of one embodiment of a data setter according to the present invention.

The data setter 10 mainly includes at least one plug 22 (shown in FIGS. 5 and 9) and, as shown enlargedly in FIGS. 2 and 3, a main body 12 of the data setter having plug-fitting portions 12A1, 12A2, 12A3, 12A4, 12A5, 12A6, 12A7 and 12A8 into which is selectively inserted the plug 22.

The main body 12 of the data setter is formed, for example, of resinous material in a rectangle solid shape, and, as shown enlargedly in FIGS. 2 and 3, has the plug-fitting portions 12A1, 12A2, 12A3, 12A4 and 12A5 arranged at given equally spaced intervals in the lengthwise direction thereof. The narrow clearance-like plug-fitting portions 12A1, 12A2, 12A3, 12A4 and 12A5 are arranged generally parallel to a short side of the main body 12 of the data setter as shown enlargedly in FIG. 3.

At an end on the plug-fitting portion 12A5 side of the main body 12 of the data setter, a notch is formed. Also, grooves 12EG are formed between the plug-fitting portions 12A1 and 12A2 and between the plug-fitting portions 12A4 and 12A5, respectively, in a side wall on the long side of the main body 12.

Since the structures of the plug-fitting portions 12A1, 12A2, 12A3, 12A4 and 12A5 are the same to each other, the explanation will be made solely on the plug-fitting portion 12A1 and that for the other plug-forming portions 12A2 to 12A5 will be eliminated.

The plug-fitting portion 12A1 has a first recess 12RA and a second recess 12RC, respectively, at opposite ends thereof, and has a third recess 12RB in an intermediate area between the both for connecting the first recess 12RA with the second recess 12RC.

The first recess 12RA with an upward opening has a rectangular cross-section in communication with the third recess 12RB as shown enlargedly in FIG. 3. In a wall portion forming a boundary between the first recess 12RA and the third recess 12RB, there is a pair of projections 12PW opposite to each other while protruding inward as shown in FIG. 2. Thereby, a communication path between the first recess 12RA and the third recess 12RB becomes narrower.

The third recess 12RB with an upward opening is communicated with both of the first recess 12RA and the second recess 12RC. A width of the third recess 12RB in the arrangement direction of the plug-fitting portions is set to be the same as the corresponding widths of the first recess 12RA and the second recess 12RC. On a peripheral edge of an end of the third recess 12RB with an upward opening, a pair of nibs 12E are formed as a portion to be detachably engaged with a nib 22N of the plug 22 described later.

Also in a wall forming a boundary between the second recess 12RC and the third recess 12RB, both of which open upward, a pair of projections 12PW are formed, which are arranged opposite to each other as shown in FIG. 2 while protruded inward as described before. Thereby, a communication path between the second recess 12RC and the third recess 12RB becomes narrower.

Between the second recess 12RC in the plug-fitting portion 12A1 and the second recess 12RC in the plug-fitting portion 12A2, between the second recess 12RC in the plug-fitting portion 12A2 and the second recess 12RC in the plug-fitting portion 12A3, and between the second recess 12RC in the plug-fitting portion 12A3 and the second recess 12RC in the plug-fitting portion 12A4, the plug-fitting portion 12A8, 12A7 and 12A6 are formed to intersect with each other.

The plug-fitting portion 12A8 is comprised of the second recess 12RC in the plug-fitting portion 12A1, the second recess 12RC in the plug-fitting portion 12A2, and a recess 12RM connecting the both with each other.

The recess 12RM is vertical to the plug-fitting portions 12A1 and 12A2 and communicated with the second recess 12RC in the plug-fitting portion 12A1 and the second recess 12RC in the plug-fitting portion 12A2.

On the peripheral edge of an end of the recess 12RM with an upward opening, there is a pair of nibs 12E as a portion to be detachably engaged with the nib portion 22N of the plug 22 described later.

A width of recess 12RM in the short side direction of the main body 12 of the data setter is set to be equal to a width of the third recess 12RB corresponding thereto.

The plug-fitting portion 12A7 is comprised of the second recess 12RC in the plug-fitting portion 12A2, the second recess 12RC in the plug-fitting portion 12A3, and the recess 12RM connecting the both with each other. The plug-fitting portion 12A6 is comprised of the second recess 12RC in the plug-fitting portion 12A3, the second recess 12RC in the plug-fitting portion 12A4, and the recess 12RM connecting the both with each other.

Note that as the structure of the recess 12RM in the plug-fitting portions 12A7 and 12A6 is the same as that of the recess 12RM in the plug-fitting portion 12A8, the redundant explanation thereof will be eliminated.

Figure 10:
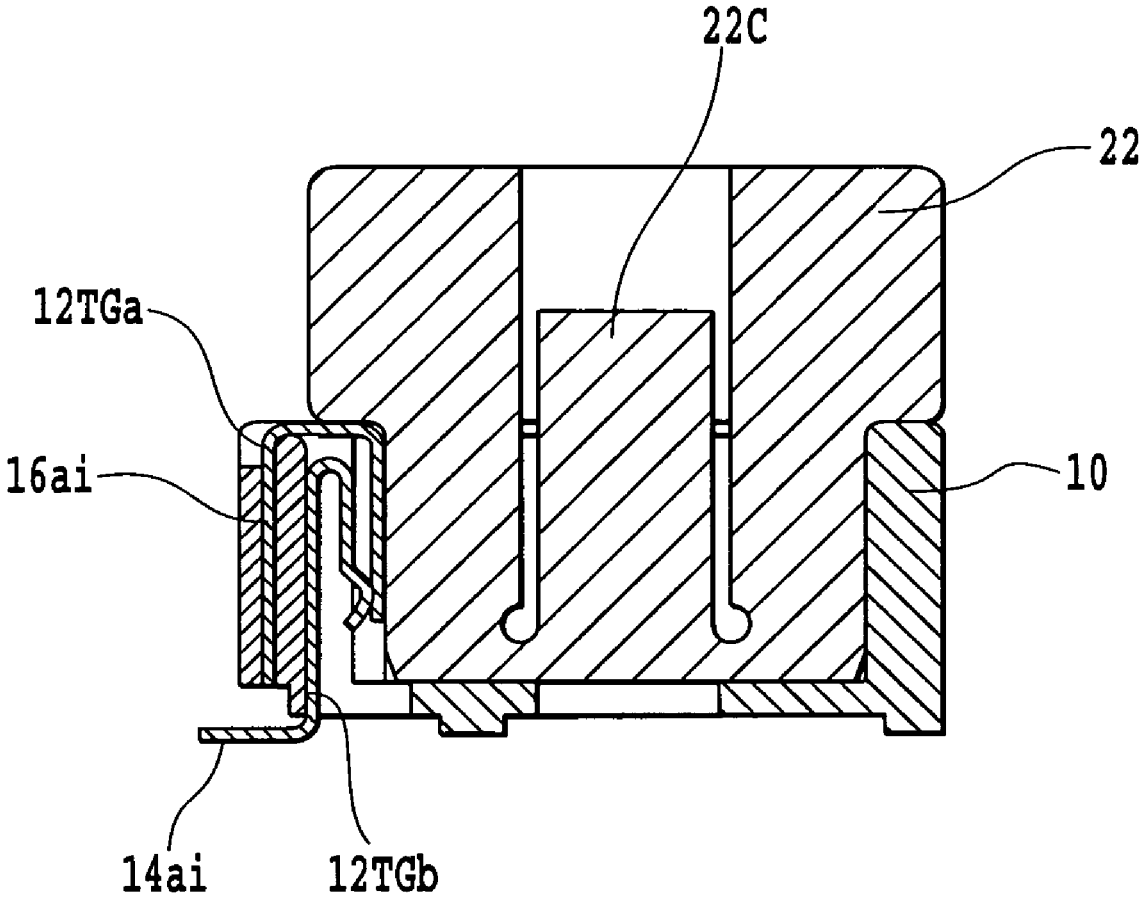
FIG. 10 is a cross-sectional view taken along a line X-X in FIG. 9.

As shown enlargedly in FIGS. 3 and 10, in the second recess 12RC in each of the plug-fitting portions 12A1 to 12A5, a contact portion of a contact unit 18 is provided, the contact unit 18 consisting of a contact terminal 14*ai* (i=1 to 5) and a contact terminal 16*ai* (i=1 to 5).

The contact terminal 14*ai* is formed, for example, of phosphor bronze, and comprised of a fixed terminal section to be soldered to the electro-conductive layer of the printed wiring board and a contact terminal section bent from the fixed terminal section and extending and then curved to form a generally U-shape.

A contact point of the contact terminal 16*ai* is selectively brought into contact with a contact point at a tip end of the contact terminal section.

The contact terminal section of the contact terminal 14*ai* is press-fit into the second recess 12RC from the underside via a slit 12TGb formed in the bottom wall forming the second recess 12RC.

On the other hand, the contact terminal 16*ai* is formed, for example, of phosphor bronze, and comprised of a fixed terminal section to be soldered to the electro-conductive layer of the printed wiring board, a contact terminal section bent from the fixed terminal section and extending and then curved to form a generally U-shape, and a fixed section for connecting the fixed terminal section with the contact terminal section. In this regard, in FIG. 3, the contact terminal section is bent to form a generally U-shape at a position in the above-mentioned fixed section deviated leftward by a predetermined distance from the fixed terminal section. The fixed section is press-fit into a groove 12TGa formed adjacent to the second recess 12RC from the upper side.

At that time, the fixed terminal section is inserted into a slit 12S on the side wall shown in FIG. 2 until reaching a common plane wherein the fixed terminal sections of the respective contact terminals 14*ai* are arranged.

As shown enlargedly in FIG. 10, the contact portion at a tip end of the contact terminal section is located nearer to the third recess 12RB than a position of the contact portion of the contact terminal 14*ai*.

As shown in FIG. 10, when the plug 22 described later is inserted into the plug-fitting portion 12A1, a contact portion of the contact terminal 16*ai* is brought into contact with the contact portion of the contact terminal 14*ai* by the pressure thereof. Also, when the plug 22 is not inserted into the plug-fitting portion 12A1, it is apart from the contact portion of the contact terminal 14*ai* by the elastic recovery force of the contact terminal section of the contact terminal 16*ai*. Thereby, a so-called "open state" of a contact portion of the contact unit 18 is maintained.

Figure 5:
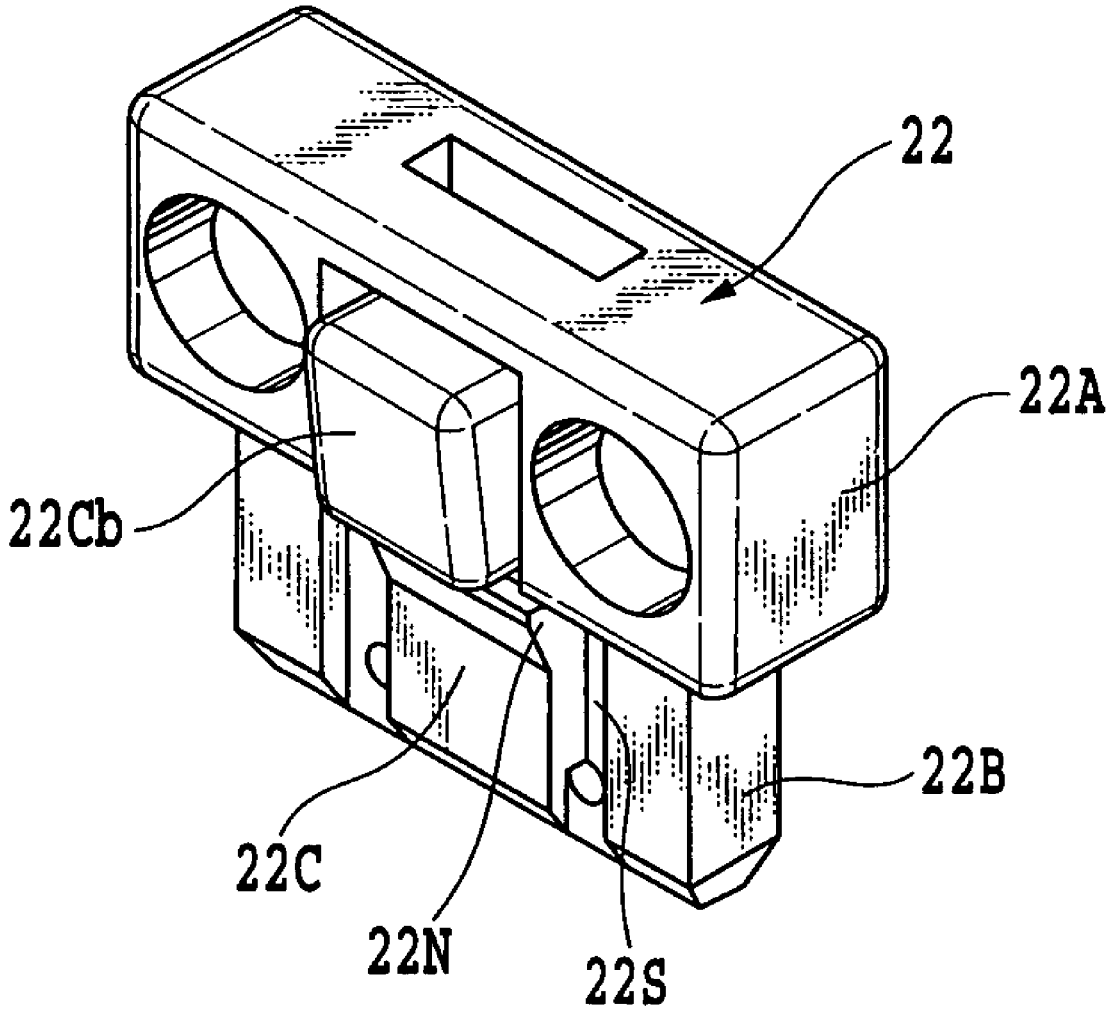
FIG. 5 is a perspective view showing an appearance of a plug constituting one embodiment of a data setter according to the present invention.

As shown enlargedly in FIG. 5, the plug 22 is formed of electro-insulative material such as resinous material, and consists of an operative section 22A gripped upon the detachment/attachment and a leg section 22B formed in integral with the operative section 22A to close the contact portion of the above-mentioned contact unit 18 when fitted within the plug-fitting portion 12A1 to 12A8.

Lengths of a long side and a short side of the rectangular solid operative section 22A are set longer than those of a long side and a short side of the open end of the plug-fitting portion 12A1 to 12A8, respectively.

An outer dimension of the leg section 22B is set somewhat smaller than the longer and shorter sides of the open end of the plug-fitting portion 12A1 to 12A8 to be able to fit with the plug-fitting portion 12A1 to 12A8.

Figure 8:
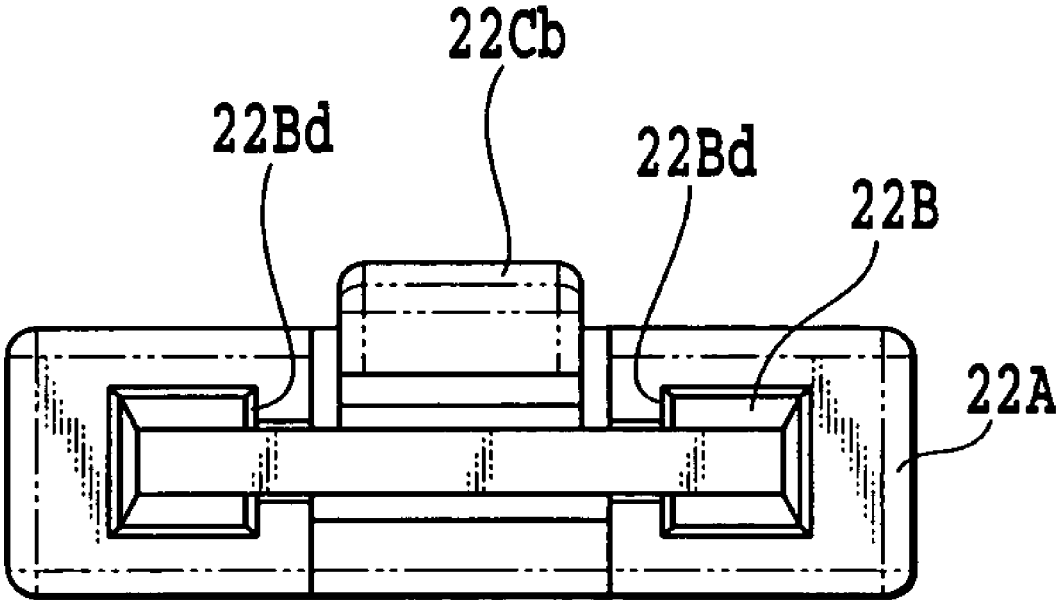
FIG. 8 is a bottom view of the plug shown in FIG. 5.

As shown enlargedly in FIG. 8, the leg section 22B has a pair of column-like portions 22Bd having a cross-sectional shape corresponding to that of the first and second recesses 12RA and 12RC in the respective plug-fitting portion, arranged generally in parallel to each other at a predetermined distance. A circumferential surface of the respective column-like portions 22Bd consisting of a plurality of surfaces crossing to each other in the vertical direction becomes a pressure surface to press the contact terminal section of the contact terminal 16*ai* to the contact terminal section of the contact terminal 14*ai*.

There is a thin wall part between the column-like portions 22Bd of the leg section 22B. A thickness of the thin wall part is selected to be able to pass through a pair of projections 12PW in the respective plug-fitting portion.

Figure 6:
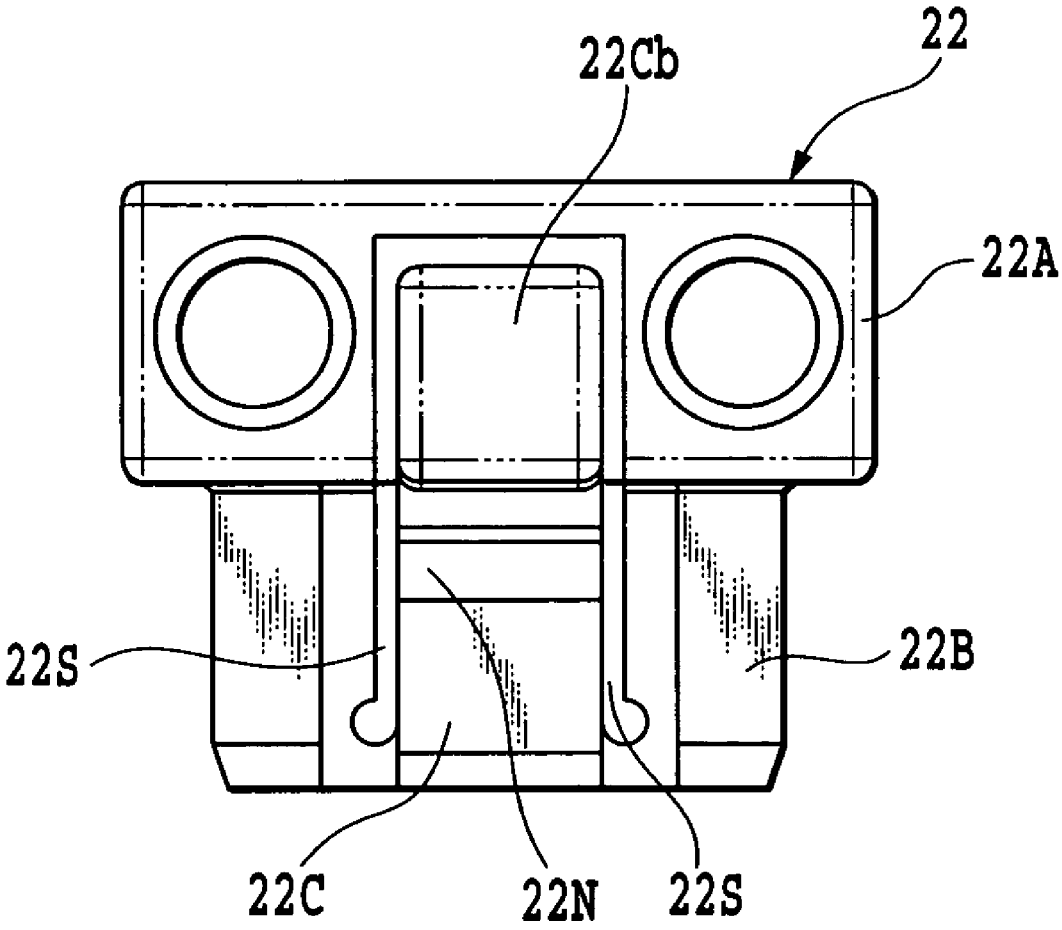
FIG. 6 is a front view of the plug shown in FIG. 5.

As shown in FIGS. 5 and 6, in a generally middle portion of the thin wall part, a base end of a locking/unlocking engagement piece 22C is formed in integral therewith to become capable of elastic displacement.

A gap 22S is formed between the circumference portion of the locking/unlocking engagement piece 22C and the interior of the leg section 22B and the operative section 22A so that the locking/unlocking engagement piece 22C is relatively rotatable about the base end thereof. The gap 22S passes through the leg section 22B and the operative section 22A.

Figure 7:
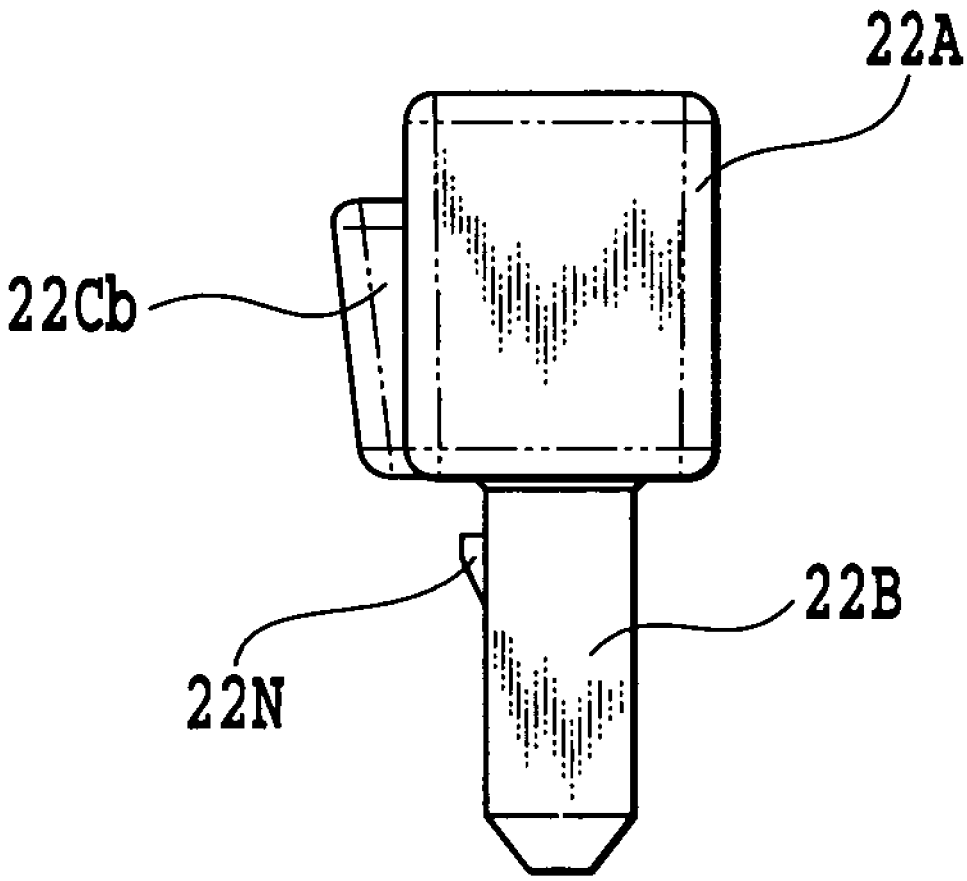
FIG. 7 is a side view of the plug shown in FIG. 5.

At the uppermost end of the locking/unlocking engagement piece 22C, a button section 22Cb is formed while projecting from the outer surface of the operative section 22A in the direction away therefrom. A nib 22N is formed in a lower part of the locking/unlocking engagement section 22C apart at a predetermined distance from the button section 22Cb, and projected away therefrom as shown in FIG. 7. The nib 22N is locked with either one of the pair of nibs 12E in the respective plug-fitting portion by the elastic force of the locking/unlocking engagement piece 22C itself when the leg section 22B is fitted within the plug-fitting portion 12A1 to 12A8. Accordingly, the leg section 22B is locked to the plug-fitting section 12A1 to 12A8 in either of the engagement direction relative to the plug-fitting portion 12A1 to 12A8; i.e., the direction wherein the button 22Cb is located in FIG. 7 (leftward direction) or that opposite thereto (rightward direction).

On the other hand, when the locking/unlocking engagement piece 22C is unlocked from the pair of nibs 12E, the button section 22Cb is pressed against its elastic force to unlock so that the nib 22N is away from the nib 12E, thereby the leg section 22B is pulled away from the plug-fitting portion 12A1 to 12A8 and easily removed.

Figure 11:
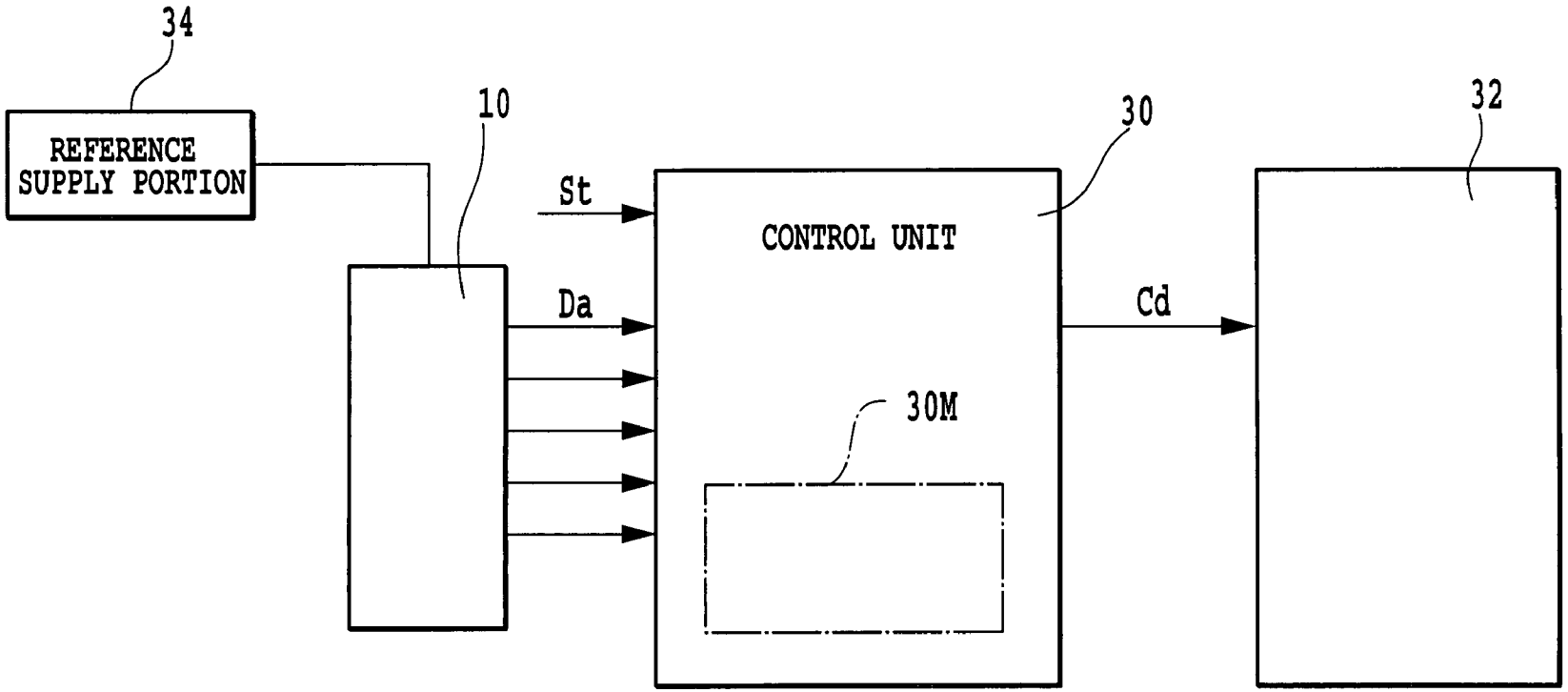
FIG. 11 is a block diagram showing a control unit connected to one embodiment of a data setter according to the present invention and a drive control circuit controlling the same.

A control unit as shown in FIG. 11 is connected to the above-mentioned data setter 10. In this regard, in FIG. 11, the control unit and a drive control circuit connected to an example of the data setter according to the present invention are illustrated.

In FIG. 11, the data setter 10 is connected to a reference supply portion 34 through the one contact terminals 14*ai* in the contact unit 18 and to the input port of the control unit 30 through the other contact terminals 16*ai* thereof.

The control unit 30 is provided on a predetermined printed wiring board. The control unit 30 is supplied from a host computer not shown with an indication signal St representing a command for starting the operation control.

The control unit 30 is supplied from the above-mentioned data setter 10 with data Da consisting of five bits configuration. The data Da represents, for example, the destination to which an electronic equipment provided with this printed wiring board is exported.

The data setter 10 is capable of setting the data Da of five bits configuration (d1, d2, d3, d4 and d5). The data Da becomes different data each other in 32 ($=2^5$) patterns by the selective arrangement of the plurality of plugs.

When the contact terminal portion of the contact terminal 16*ai* is pressed to the contact terminal portion of the contact terminal 14*ai* by the pressing surface of the column-like portion 22Bd of the plug 22, that is, if the contact portions of the respective contact units 18 are in a closed state, data [1] (high level) is formed; while if the contact portions of the respective contact units 18 are in an open state, data [0] (low level) is formed.

Figure 1:
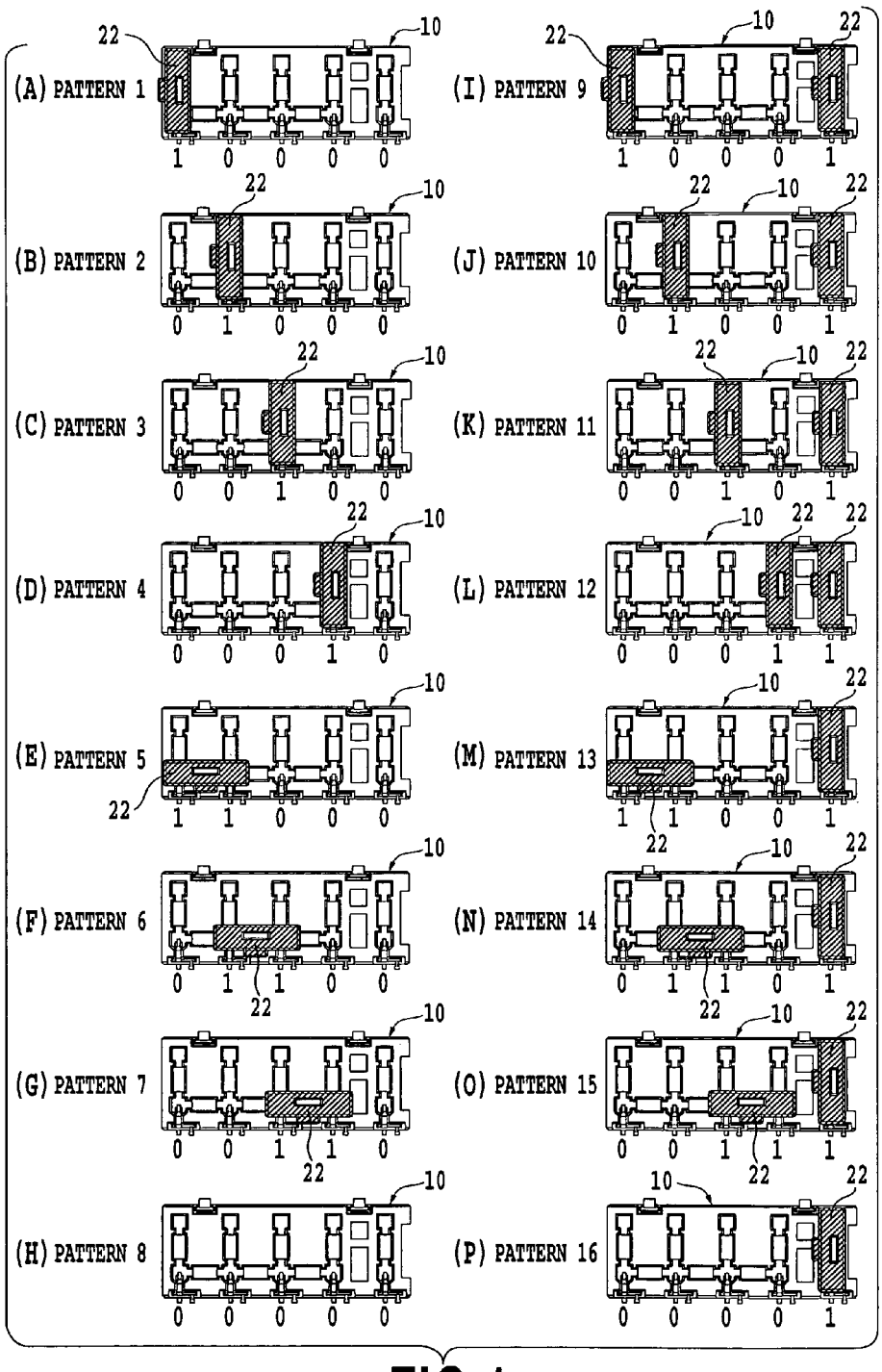

(A) to (P) of FIG. 1 illustrate the arrangement of the plug 22 when 16 patterns in 32 patterns of data are set, respectively.

(A) to (G) and (P) of FIG. 1 represent data Da (d1, d2, d3, d4 and d5) set by using one plug. (I) to (O) in FIG. 1 represent data Da (d1, d2, d3, d4 and d5) set by using two plugs. (H) in FIG. 1 represents a state wherein no plug 22 is inserted.

In (A) to (D) of FIG. 1, since the contact portions of the contact units 18 corresponding to the plug-fitting portions 12A1, 12A2, 12A3 and 12A4 into which are inserted the plug 22 become the closed state, the data (binary digit) is [1]. On the other hand, the contact portions of the contact units 18 corresponding to the other plug-fitting portions become the open state whereby the data (binary digit) is [0].

Accordingly, in examples shown (A) to (D) of FIG. 1, the data setter 10 sets supplied data Da (d1, d2, d3, d4 and d5) as (1, 0, 0, 0, 0); (0, 1, 0, 0, 0); (0, 0, 1, 0, 0) and (0, 0, 0, 1, 0), respectively.

In (E) to (G) of FIG. 1, since the contact portions of the two contact units 18 corresponding to the plug-fitting portions 12A8, 12A7 and 12A6 into which are inserted the plug 22 become the closed state, the data (binary digits) are simultaneously [1], while since the contact portions of the contact units 18 corresponding to the other plug-fitting portions become the open state, the data (binary digits) are [0].

Accordingly, in the examples in (E) to (G) of FIG. 1, the data setter 10 sets supplied data Da (d1, d2, d3, d4 and d5) as (1, 1, 0, 0, 0), (0, 1, 1, 0, 0), (0, 0, 1, 1, 0) respectively.

In (I) to (O) of FIG. 1, since the contact portions of the contact units 18 corresponding to the plug-fitting portions 12A1 and 12A5 (see FIG. 1 (I)), 12A2 and 12A5 (see FIG. 1 (J)), 12A3 and 12A5 (see FIG. 1 (K)), 12A4 and 12A5 (see FIG. 1 (L)), 12A8 and 12A5 (see FIG. 1 (M)), 12A7 and 12A5 (see FIG. 1(N)), and 12A6 and 12A5 (see FIG. 1(O)) into which are inserted the two plugs 22 become the closed state, the data (binary digits) are simultaneously [1], while since the contact portions of the contact units 18 corresponding to the other plug-fitting portions become the open state, the data (binary digits) are [0].

Accordingly, in the examples shown in (I) to (O) of FIG. 1, the data setter 10 sets supplied data Da (d1, d2, d3, d4 and d5) as (1, 0, 0, 0, 1), (0, 1, 0, 0, 1), (0, 0, 1, 0, 1), (0, 0, 0, 1, 1), (1, 1, 0, 0, 1), (0, 1, 1, 0, 1), and (0, 0, 1, 1, 1), respectively.

In this regard, when three plugs 22 are used and inserted into the plug-fitting portions 12A8, 12A6 and 12A5 (not shown), the data setter 10 sets supplied data Da (d1, d2, d3, d4 and d5) as (1, 1, 1, 1, 1). Note that the number of the used plugs 22 should not be limited to the above-mentioned examples, but may be five at the maximum.

Thus, it is possible to visually confirm the content of the set data by checking the arrangement of the plugs 22 in the data setter. Also, data set by the data setter is easily changeable by mechanically varying the arrangement of the plugs 22 without bringing the printed wiring board on which is mounted the data setter into operation. Thereby, the reconfirmation of the content of the changed data becomes unnecessary.

The control unit 30 is provided with a data storage section 30M in the interior thereof. In the data storage section 30M, there is a storage of program data for controlling the operation of the drive control circuit 32 corresponding to the respective destination, connected to the control unit 30 described later, data representing a kind of the drive control circuit corresponding to the respective destination, and lookup table data such as an supply portion voltage or an operation frequency corresponding to the respective destination.

When the indication signal St is supplied, the control unit 30 reads the program data or others corresponding to the delivery destination from the data storage section 30M in accordance with the data Da from the data setter, forms a group Cd of control signals based thereon, and supplies them to the drive control circuit 32. Thereby, the drive control circuit 32 carries out the drive control corresponding to the respective delivery destination based on the group of control signals Cd.

Figure 12:
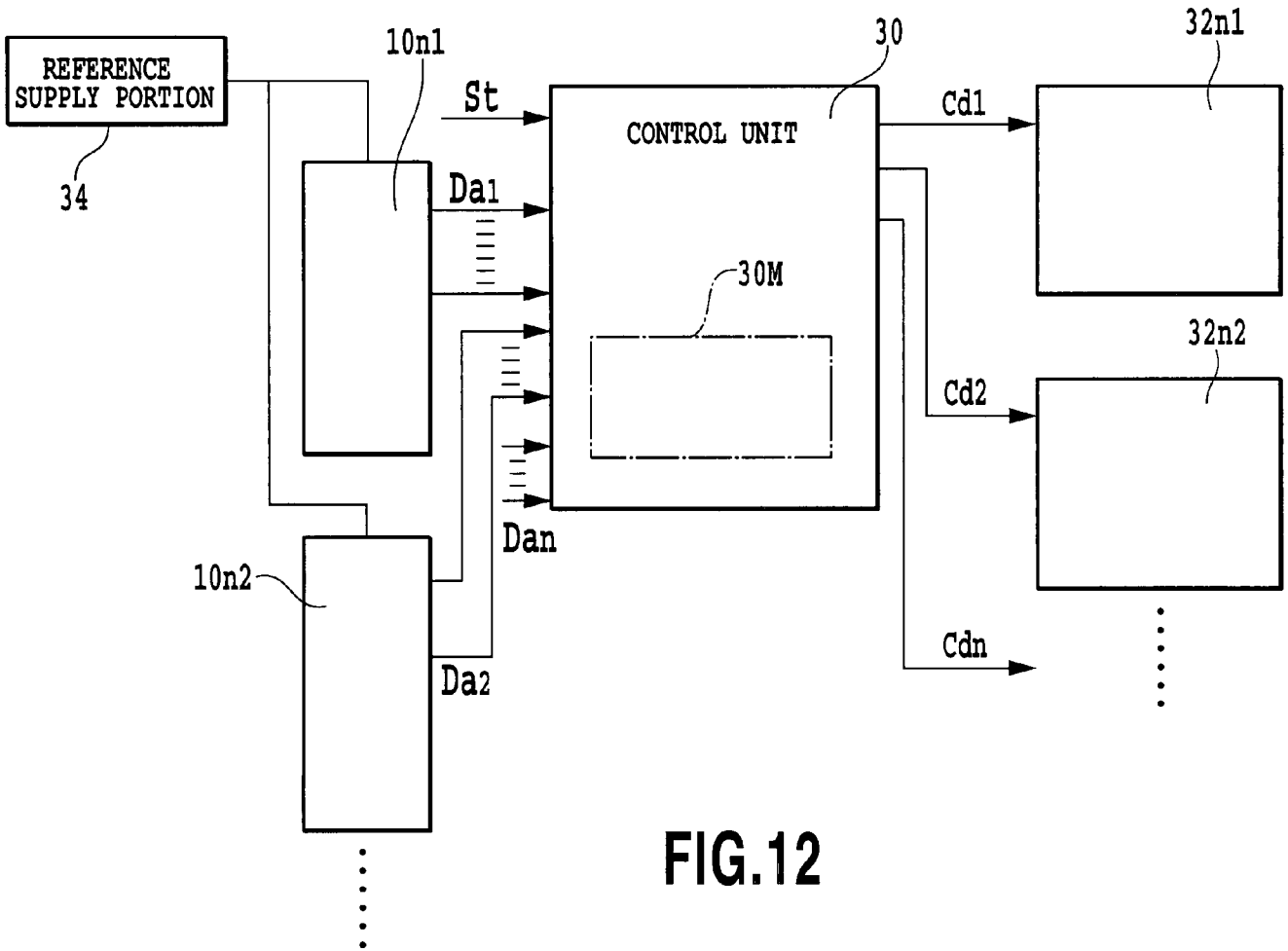
FIG. 12 is a block diagram showing a control unit to which are connected a plurality of data setters according to one embodiment of the present invention and a drive control circuit controlled thereby.

FIG. 12 illustrates a control unit to which are connected a plurality of data setters according to the present invention as well as a plurality of drive control circuits.

In the embodiment shown in FIG. 12, there are provided a plurality of data setters 10*n*1, 10*n*2, . . . , 10*nm* (m is a positive integer) for individually setting data representing the destination different from each other, and drive control circuits 32*n*1, 32*n*2, . . . , 32*nm* (m is a positive integer) corresponding to the respective data setters.

In this regard, in FIG. 12, the same elements as in the example shown in FIG. 11 are denoted by the same reference numerals and the redundant description thereof will be eliminated.

Each of the data setters 10*n*1, 10*n*2, . . . , 10*nm* has the same structure as in the above-mentioned data setter 10.

In each of the data setter 10*n*1, 10*n*2, . . . , 10*nm*, one contact terminal 14*ai* in the contact terminal 14*ai* is connected to a predetermined reference supply portion 34, and the other contact terminal 16*ai* is connected to the input port of the control unit.

The control unit 30 is provided on the predetermined printed wiring board. In the control unit 30, is supplied with an indication signal St representing the command for starting the operation control from the host computer not illustrated. In the control unit 30, data Da1, Da2, . . . , Dan (n is a positive integer) consisting of five bits are supplied from the above-mentioned data setters 10*n*1, 10*n*2, . . . , 10*nm*. Data Dan represents, for example, the destination to which is delivered the electronic equipment mounting this printed wiring board.

When the indication signal St is supplied, the control unit 30 reads the program data and other data corresponding to the delivery destination thereof from the data storage section 30M, forms the group of control signals cd1, cd2, . . . , cdn based thereon, and supplies them to the drive control circuits 32*n*1, 32*n*2, . . . , 32*nm*. Thereby, the drive control circuits 32*n*1, 32*n*2, . . . , 32*nm* carry out the drive control in correspondence to the respective delivery destinations, based on the group of control signals Cd1, Cd2, . . . , Cdn.

While the data setter sets the data representing the delivery destination in the above-mentioned embodiment of the data setter according to the present invention, this is not limitative, but the data setter may, of course, be applied to data consisting of five bits configuration representing other content. Also, in the above-mentioned embodiment, while eight plug-fitting portions are formed, this is not limitative, but the number of the plug-fitting portions may be increased or decreased in accordance with the bits configuration of the desired set data.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A data setter comprising:

at least one plug formed of electric-insulation material, having a leg portion defining a circumference portion forming a pressing surface, and an operative portion;

a main body of the data setter having a plurality of plug-fitting portions to which are detachably fit the leg portions of the plug; and a plurality of contact units arranged in the respective plug-fitting portions of the main body of the data setter and connected to a reference supply portion, wherein when the leg portion of said plug is fit into at least one of the selected plug-fitting portions among the plurality of plug-fitting portions, a plurality of kinds of data formed of a plurality of binary data are set by pressing at least one of the contact units with the pressing surface of said plug to be in a conductive state.

2. The data setter as claimed in claim 1, wherein the first and second plug-fitting portions having said contact units, respectively, are formed apart from each other, and the third plug-fitting portion is formed to be vertical to the first and second plug-fitting portions each other.

3. The data setter as claimed in claim 1, wherein said plug has a locking/unlocking engagement piece detachably engageable with a nib formed at an open end of the plug-fitting portion.

4. The data setter as claimed in claim 1, wherein said contact unit comprises a first contact terminal having a contact portion capable of displacement by the pressure of said plug when said plug is fit into the plug-fitting portion and a second contact terminal having a contact portion being brought into contact with the contact portion of the first contact terminal by the displacement of the contact portion of the first contact.

5. The data setter as claimed in claim 1, wherein lengths of a long side and a short side of the operative section of said plug are set longer than those of a long side and a short side of the open end of the plug-fitting portion, respectively and an outer dimension of the leg section of said plug is set smaller than the longer and shorter sides of the open end of the plug-fitting portion.

6. The data setter as claimed in claim 2, wherein the plug-fitting portion has a first recess and a second recess, respectively, at opposite ends thereof, and has a third recess in an intermediate area between the both for connecting the first recess with the second recess.

7. The data setter as claimed in claim 3, wherein a pair of nibs are formed at an open end of the plug-fitting portion and the locking/unlocking engagement piece is engaged with either one of the pair of nibs.

8. The data setter as claimed in claim 3, wherein a button section is formed while projecting from the outer surface of the operative section in the direction away therefrom at the uppermost end of the locking/unlocking engagement piece.

9. The data setter as claimed in claim 4, wherein the plug-fitting portion has a first recess and a second recess, respectively, at opposite ends thereof, and has a third recess in an intermediate area between the both for connecting the first recess with the second recess and the contact portion of the first contact terminal is located in the second recess.

10. The data setter as claimed in claim 6, wherein the first and the second recesses of the third plug-fitting portion are the second recess of the first and second plug-fitting portions, respectively.

* * * * *